US008561987B2

(12) United States Patent
Berlingen et al.

(10) Patent No.: US 8,561,987 B2
(45) Date of Patent: Oct. 22, 2013

(54) MACHINE FOR PROCESSING SHEETS

(75) Inventors: Detlev Berlingen, Heidelberg (DE); Ulrich Fellenberg, Schwetzingen (DE); Frank Gunschera, Nussloch (DE); Sven Lippardt, Bensheim (DE); Frank Schramm, Fürfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1962 days.

(21) Appl. No.: 10/888,278

(22) Filed: Jul. 9, 2004

(65) Prior Publication Data

US 2005/0012265 A1 Jan. 20, 2005

(30) Foreign Application Priority Data

Jul. 16, 2003 (DE) ..... 103 32 217

(51) Int. Cl.
*B65H 5/02* (2006.01)

(52) U.S. Cl.
USPC ..... 271/276; 271/3.22

(58) Field of Classification Search
USPC ..... 271/276, 275, 3.22, 204
See application file for complete search history.

(56) References Cited

U.S. PATENT DOCUMENTS

| | | | | |
|---|---|---|---|---|
| 3,542,358 | A | 11/1970 | Schuhmann | |
| 3,663,012 | A * | 5/1972 | Van Den Honert | 271/276 |
| 3,942,787 | A * | 3/1976 | Bolza-Schunemann | 271/237 |
| 4,357,870 | A * | 11/1982 | Rudolph et al. | 101/246 |
| 4,693,784 | A | 9/1987 | Aula et al. | |
| 4,998,715 | A * | 3/1991 | Milan et al. | 271/297 |
| 5,419,254 | A * | 5/1995 | DeMoore et al. | 101/420 |
| 5,599,013 | A | 2/1997 | Detmers et al. | |
| 5,626,075 | A | 5/1997 | Detmers et al. | |
| 5,865,433 | A * | 2/1999 | Morrissette | 271/276 |
| 5,988,633 | A * | 11/1999 | Henn et al. | 271/204 |
| 6,205,899 | B1 | 3/2001 | Blumle et al. | |
| 6,213,462 | B1 * | 4/2001 | Schmidt | 271/204 |
| 2002/0043758 | A1 * | 4/2002 | Kelm et al. | 271/277 |
| 2002/0135123 | A1 * | 9/2002 | Maul et al. | 271/277 |

FOREIGN PATENT DOCUMENTS

| | | |
|---|---|---|
| CA | 2139084 | 12/1994 |
| DE | 1 561 043 | 3/1970 |
| DE | 36 10 898 A1 | 10/1986 |
| DE | 42 23 839 C1 | 12/1993 |
| DE | 44 36 955 A1 | 4/1996 |
| DE | 198 41 834 A1 | 3/2000 |
| DE | 199 41 633 A1 | 3/2001 |

OTHER PUBLICATIONS

Kipphan, Helmut: "Handbuch der Printmedien" [Manual of Print Media], Springer Verlag, vol. 1, 2001, pp. 261 and 266.

* cited by examiner

*Primary Examiner* — Stefanos Karmis
*Assistant Examiner* — Kalyanavenkateshware Kumar
(74) *Attorney, Agent, or Firm* — Laurence A. Greenberg; Werner H. Stemer; Ralph E. Locher

(57) ABSTRACT

The invention relates to a machine for processing sheets, having a deliverer for delivering the sheets which comprises a delivery drum that is acted on pneumatically. The delivery drum has vacuum applied to it. The delivery drum also has disks for carrying the sheets, each of the disks defining vacuum channels for holding the sheets. The vacuum channels have openings and a vacuum connection. The openings and the vacuum connection together form a rotary valve cyclically applying vacuum to the vacuum channels.

8 Claims, 3 Drawing Sheets

MACHINE FOR PROCESSING SHEETS

BACKGROUND OF THE INVENTION

Field of the Invention

The present invention relates to a machine for processing sheets, having a delivery for delivering the sheets that includes a delivery drum that is acted on pneumatically.

In German Patent DE 1 561 043 corresponding to U.S. Pat. No. 3,542,358 to Schuhmann, such a machine, whose delivery drum is acted on with blown air, is described. By the application of positive pressure to the delivery drum, a thin air cushion is formed between the sheet and the drum periphery, which prevents the printing ink from the sheet being smeared onto the drum. However, the application of positive pressure does not manage to prevent the printing ink smearing from the sheet transported by the delivery drum to the machine parts adjacent to the delivery drum.

SUMMARY OF THE INVENTION

It is accordingly an object of the invention to provide a machine for processing sheets that overcomes the hereinafore-mentioned disadvantages of the heretofore-known devices of this general type and that has a delivery drum the transports the sheets safely past the adjacent machine parts without smearing.

With the foregoing and other objects in view, there is provided, in accordance with the invention, a machine for processing sheets, having a delivery, or deliverer, for delivering the sheets includes a delivery drum that is acted on pneumatically, is characterized by acting on the delivery drum with a vacuum.

As a result of acting on the delivery drum with a vacuum, in the machine according to the invention, a route for solving the problem—which is completely opposite to the prior art (e.g., German Patent DE 1 561 043)—is followed. It has been found that, for the protection against smearing onto the adjacent machine parts, it is much more effective to keep the sheet in contact with the delivery drum for some time by a vacuum of the latter, instead of keeping the sheet at a distance from the delivery drum by a blown air cushion.

Advantageous developments will be explained briefly in detail in the following text.

In an advantageous development with regard to protecting the sheets against smearing of their printed image as a result of the contact between the sheet and delivery drum necessitated by the application of vacuum, in accordance with another feature of the invention, the delivery drum includes disks for carrying the sheets. Because of the narrowness of the disks, these carrying disks support the sheet only locally, as seen over its sheet width, and not over the entire sheet width. As viewed in the direction of the sheet width, the disks can be disposed after one another such that contact points determined by the disks are located within corridors that are free of a printed image and that run in the longitudinal direction of the respective sheet. What is important to the disks is primarily their narrowness and less whether the respective disk is circular, corresponding to a full circle or, instead, only has the shape of a circular segment, or whether the respective disk is produced from one piece or is assembled from a plurality of segments. As a result of the interaction between the application of vacuum and the disks of the delivery drum, the sheet is held exactly and in a stable position on its necessary transport path, and the printing ink from the sheet can smear neither onto the delivery drum nor onto the machine parts adjacent to the delivery drum. The delivery drum is, therefore, particularly well suited to transporting sheets printed on both sides.

In accordance with a further feature of the invention, each of the disks includes vacuum channels for holding the sheets. Although it is also conceivable to act on a drum part adjacent to the respective disk with the vacuum holding the sheet on the delivery drum, the application of vacuum to the disks themselves, carried out by the vacuum channels, is more advantageous from a functional and constructional point of view. The vacuum channels can have openings in the peripheral surface of the respective disk, and these openings can form a row running in the peripheral direction of the disk.

In a departure from this development, however, it is also conceivable to provide only a single vacuum channel for each disk and a vacuum groove that extends in the peripheral direction of the disk, in its peripheral surface, which is open toward the sheet and in the base of which the vacuum channel opens.

In a development that is advantageous with regard to avoiding drawing extraneous air into the delivery drum, in accordance with an added feature of the invention, the openings of the vacuum channels and a vacuum connection together form a rotary valve for the cyclic application of vacuum to the vacuum channels. The rotary valve ensures that each of the vacuum channels is connected at least once to the vacuum in the course of a complete revolution of the disk and is, then, isolated from the vacuum again. Although it is, likewise, conceivable for a common rotary valve to be associated with the disks (whose number is at least two and, preferably, exactly two), the valve controlling the vacuum in the vacuum channels of all the disks cyclically, it can be advantageous from various points of view to assign a different, dedicated rotary valve to each of the disks so that the rotary valves work with one another in parallel operation.

In accordance with an additional feature of the invention, a vacuum-active angular range of the delivery drum is determined by the rotary valve or by each rotary valve, and is located in an exit pocket of a drum-cylinder nip. The rotary valve, therefore, ensures that the suction action from the delivery drum or its disks is exerted in a targeted manner in the exit pocket on the sheet section that has already emerged from the drum-cylinder nip and not on the sheet section that has not yet entered the drum-cylinder nip. In the region of an inlet pocket of the drum-cylinder nip, opposite the exit pocket, the vacuum channels are kept vacuum-inactive by the rotary valve so that the vacuum channels attract the sheet by suction at the earliest in the drum-cylinder nip in the course of its rotation.

In accordance with yet a further feature of the invention, a sheet guide device that is adjacent to the delivery drum extends into the vacuum-active angular range. Such a sheet guide device is a machine element that is immediately adjacent to the delivery drum and that is intended to be protected against smearing by the application of vacuum to the delivery drum. The rotary valve or each rotary valve activates the vacuum of the delivery drum in the cycle of the sheets conveyed through between the delivery drum and the sheet guide device. The sheet guide device is, preferably, a pneumatically acting sheet guide device that is equipped with air nozzles, preferably, with blown air nozzles assisting the vacuum of the delivery drum from the opposite side. For example, the sheet guide device can be formed as a blown air box or as a blower pipe configuration.

In a development that is advantageous with regard to pneumatic stabilization of the sheet position of one and the same sheet carried out simultaneously before and after the drum-cylinder nip, in accordance with yet another feature of the invention, the drum-cylinder nip is formed by the delivery drum together with an impression cylinder, and a blowing device for blowing the sheets against the impression cylinder is allocated to the impression cylinder. The blown air from the blowing device is aimed at the sheet and presses the sheet firmly against the peripheral surface of the impression cylinder. The vacuum-active angular range of the delivery drum and the blowing device are disposed to be offset from each other along the sheet transport path such that the blowing device holds the rear half of the sheet still on the impression cylinder while the front half of the sheet is already being held by the activated vacuum channels on the delivery drum.

In accordance with yet an added feature of the invention, the blowing device is allocated to the impression cylinder between a press nip formed by the impression cylinder and the drum-cylinder nip. As viewed in the direction of movement of the sheets, the blowing device is, therefore, disposed after the press nip and before the drum-cylinder nip. The impression cylinder can form the press nip together with a blanket cylinder provided for offset printing or instead for full-surface varnishing or with a printing form cylinder bearing a flexographic printing form for spot varnishing.

In accordance with yet an additional feature of the invention, at least one of the disks is mounted such that it can be adjusted relative to another of the disks in the direction of the width of the sheets, that is to say, transversely with respect to the transport direction of the sheets. The disk is, preferably, mounted such that it can be set as desired to various distances relative to the other disk. This setting can, preferably, be carried out continuously so that, within the adjustment range of the disk, any desired distance between the adjustable disk and the other disk can be set. The respectively selected distance, at which the disk is secured after its setting, can depend on the format of the sheets (sheet width) or on the position of the already mentioned corridors of the sheet that are free of a printed image.

In accordance with again another feature of the invention, the delivery drum is disposed or mounted within a circulation path of a chain conveyor. This means that the delivery drum is disposed such that chains of the chain conveyor run around the delivery drum.

In accordance with again a further feature of the invention, the machine according to the invention is, preferably, configured as a perfecting press. In such a perfecting press, each sheet is printed on both its sides in a single printing cycle. In connection with such sheets printed on both sides, the envisaged anti-smearing measures (vacuum application, disks) come fully into effect. As a result of the vacuum application, smearing of the printed image on the sheet side facing away from the delivery drum is avoided, by its contact with the sheet guide device being avoided and, by the disks, at the same time smearing of the other printed image on the sheet side facing the delivery drum is avoided by the facing sheet side being supported by the disks only in unprinted regions, that is to say, outside the printed image.

With the objects of the invention in view, there is also provided a machine for processing sheets, including a delivery for delivering the sheets, the delivery having a delivery drum with a surface and a vacuum source fluidically connected to the delivery drum and applying a negative pressure vacuum to the delivery drum to draw air from the surface of the delivery drum.

With the objects of the invention in view, there is also provided a machine for processing sheets, including a delivery for delivering the sheets, the delivery having a delivery drum acted on pneumatically by having a vacuum applied thereto, disks for carrying the sheets, each of the disks defining vacuum channels for holding the sheets, and the vacuum channels having openings and a vacuum connection, the openings and the vacuum connection together forming a rotary valve cyclically applying the vacuum to the vacuum channels.

Other features that are considered as characteristic for the invention are set forth in the appended claims.

Although the invention is illustrated and described herein as embodied in a machine for processing sheets, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
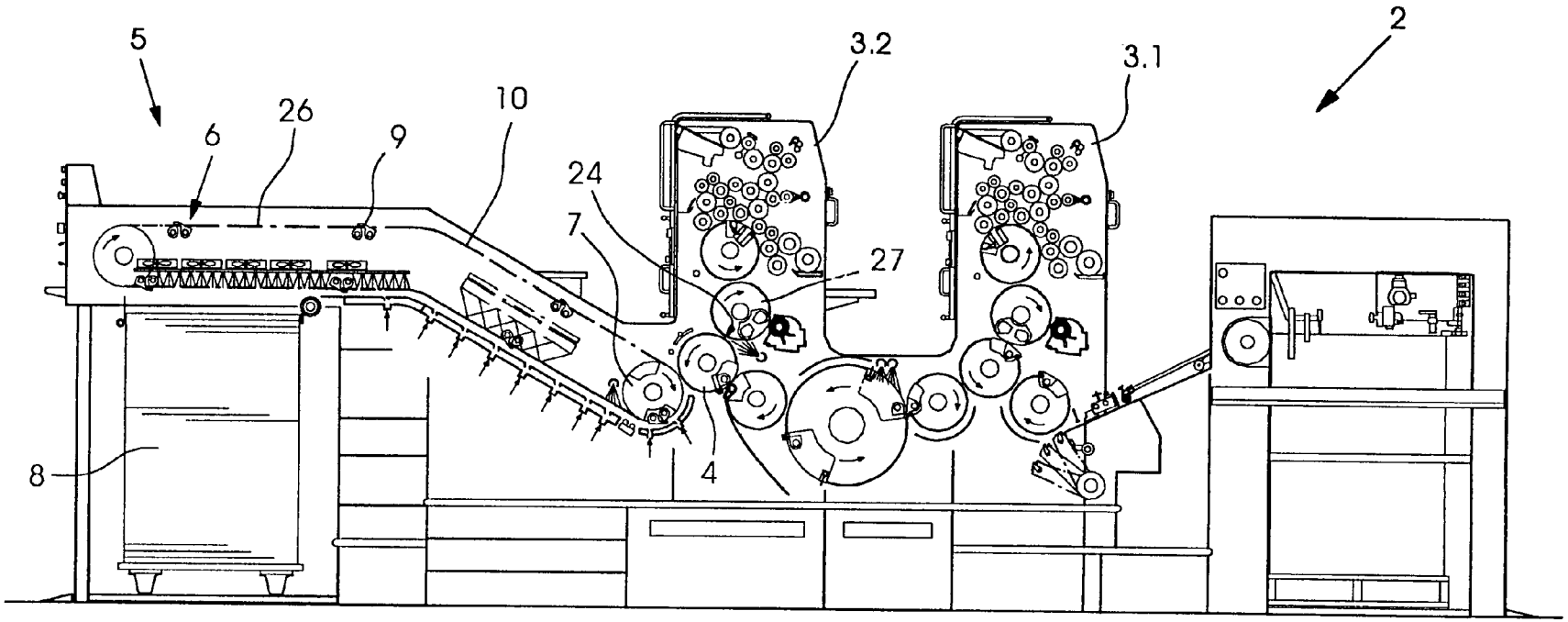
FIG. 1 is a cross-sectional view of an overall diagrammatic illustration of a press having a sheet delivery according to the invention.

Referring now to the figures of the drawings in detail and first, particularly to FIG. 1 thereof, there is shown a machine 2 processing sheets 1. The machine 2 is a sheet-fed press, specifically a recto and verso press, and includes a printing unit 3.1 for printing the front side of the sheet and a printing unit 3.2 for printing the rear side of the sheet. The printing unit 3.2 includes an impression cylinder 4 and a blanket cylinder 27, these two cylinders 4 and 27 together forming a press nip 24. In addition, the machine 2 includes a delivery 5 having a chain conveyor 6 and what is referred to as a delivery drum 7. The chain conveyor 6 runs around the delivery drum 7 and deposits the sheets 1 on a stack 8. The chain conveyor has grippers 9, which move along a circulation path 26, and chains 10 that carry the grippers 9 and determine the circulation path 26. The impression cylinder 4 transfers the sheets 1 one after another to the grippers 9 at a transfer point. The transfer point is a drum-cylinder nip 23 formed by the delivery drum 7 together with the impression cylinder 4 and is located in the first quadrant of the delivery drum 7 if a sheet transport direction from right to left is used as a basis, as in FIG. 1.

The delivery drum 7 is what is referred to as a skeleton drum and has disks 11 that carry the sheets 1 and are seated at a distance from one another on a rotating axle 25. Each of the two disks 11 is mounted such that it can be displaced individually and relative to the other of the two disks 11 along the axle 25. As a result of the displacement of the two disks 11, these can be adjusted closer together or further apart as desired, and each of the two disks 11 can be positioned in a manner coordinated with the sheet format of the respective print job such that the disks 11 contact the sheets 1 only at their side edges free of a printed image. Used as the axle 25 is what is referred to as the sprocket shaft, on which there are seated sprockets 12 that engage in the chain teeth and belong to the chain conveyor 6. The disks 11 have diametrical clearances 13, into which the grippers 9, formed as gripper bars, dip during their circulation. The peripheral speeds of the chain conveyor 6 and of the delivery drum 7 or the disks 11 are synchronized. In addition, each disk 11 is associated with a securing device 14, by which the corresponding disk 11 can be fixed on the axle 25 in its respective axial position suitable for the format, for example, can be clamped firmly. The external diameter of the disks 11 substantially corresponds to that of the sprockets 12 and of the impression cylinder 4.

The delivery drum 7, which is acted on pneumatically internally, is what is referred to as a vacuum drum and has vacuum channels 15 that are introduced into the disks 11. The vacuum channels 15 extend longitudinally substantially radially and open in the peripheral surface of the respective disk 11. Openings 16 of the vacuum channels 15 are disposed in rows, which run in the peripheral direction of the delivery drum 7 and extend substantially over the entire sheet length of the maximum sheet format. Each of the vacuum channels 15 is formed from a radial bore and a transverse bore that extends parallel to the axle 25 and intersects the radial bore. The transverse bores forming the inner ends of the vacuum channels 15 each have an opening 17.

These openings 17 of the vacuum channels 15 cooperate periodically in the course of the rotation of the respective disk 11 with a stationary vacuum connection 18, which does not co-rotate with the disk 11. The vacuum connection 18 is a groove in the shape of a circular arc and is permanently under a negative pressure that is produced by a vacuum source 30 (only illustrated diagrammatically in FIG. 2), which is connected to the vacuum connection 18. The vacuum connection 18 is open toward the openings 17 that, in the course of the rotation of the disks 10 about the geometric axis of rotation of the axle 12, overlap one after another with the vacuum connection 18 to which vacuum is applied conducting vacuum from the vacuum channels 15 into the vacuum connection 18. Each of the curved rows formed by the openings 17, as viewed in the peripheral direction, is longer than the curved length of the vacuum connection 18 so that always only a subset of the vacuum channels 15 of the respective row and never all the vacuum channels 15 of this row communicates simultaneously with the vacuum connection 18. The vacuum channels 15, together with the vacuum connection 18, therefore, form a rotary valve 19, which is placed such that the delivery drum 7 is pneumatically active with respect to the outside only within an angular range $\alpha$ that begins substantially only at the transfer point/drum cylinder nip 23 and ends still in the fourth quadrant of the delivery drum 7. The angular range $\alpha$ is located in the immediate vicinity of an exit pocket 22 from the drum-cylinder nip 23. Because of the alignment of the rotary valve 19, the openings 16 are active in applying vacuum to the sheets 1 only within the angular range $\alpha$. Within the angular range $\alpha$, it is particularly important that the sheet 1 transported to the chain conveyor 6 is attracted against the delivery drum 7 by suction by the openings 16 to which vacuum is applied and is kept in contact with the rotating disks 10 and at a distance from a sheet guide device 20, which extends with its curved end section as far as the angular range a underneath the delivery drum 7.

The sheet guide device 20, running in a curve partly around the delivery drum 7, includes a guide plate provided with blower nozzles. A blowing device 21 aimed with its blown air jets at the impression cylinder 4, substantially in the second quadrant of the impression cylinder 4, is used to hold the sheet 1 on the impression cylinder 4.

Figure 2:
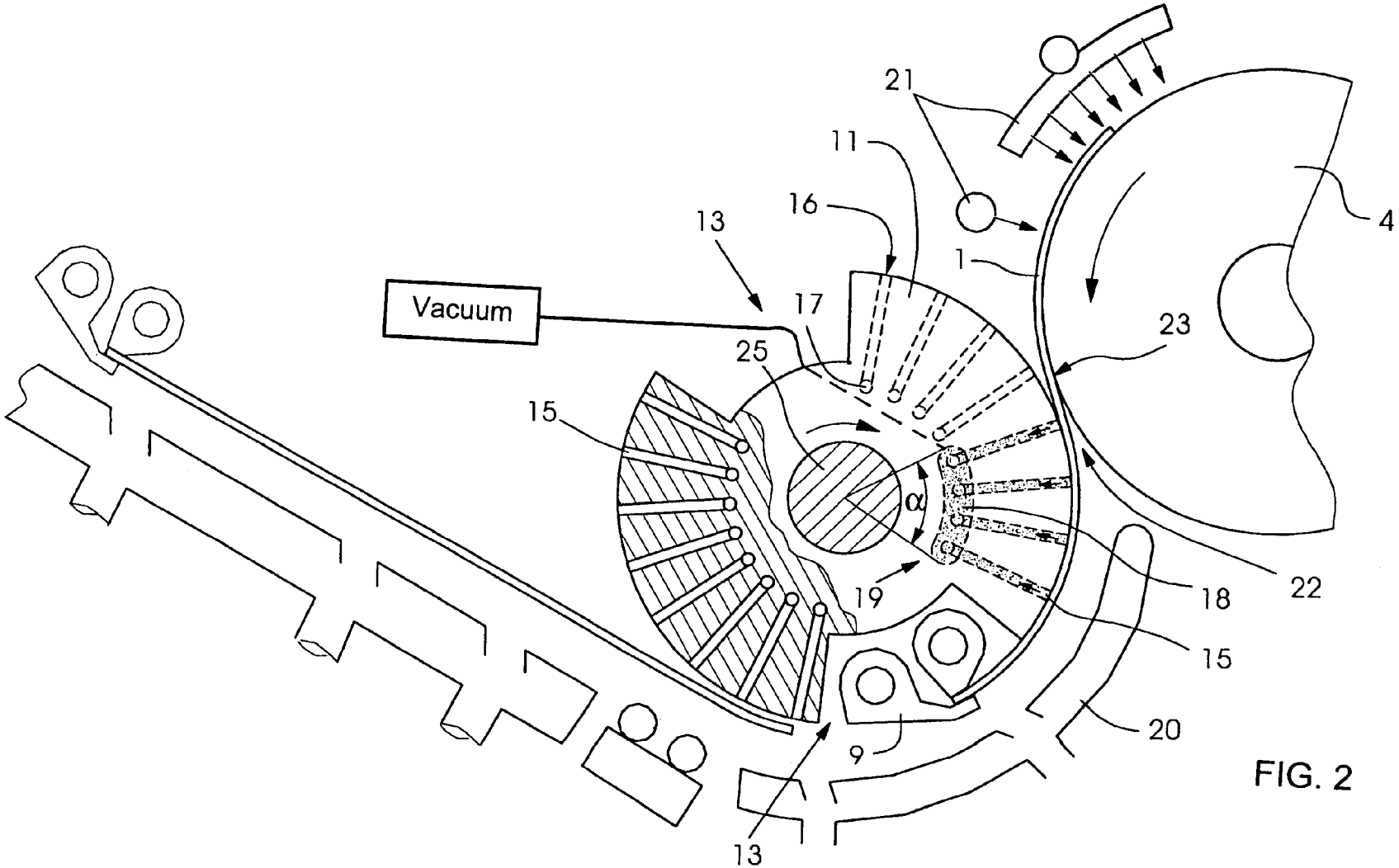
FIG. 2 is a fragmentary, cross-sectional view of a delivery drum of the sheet delivery of FIG. 1.
Figure 3:
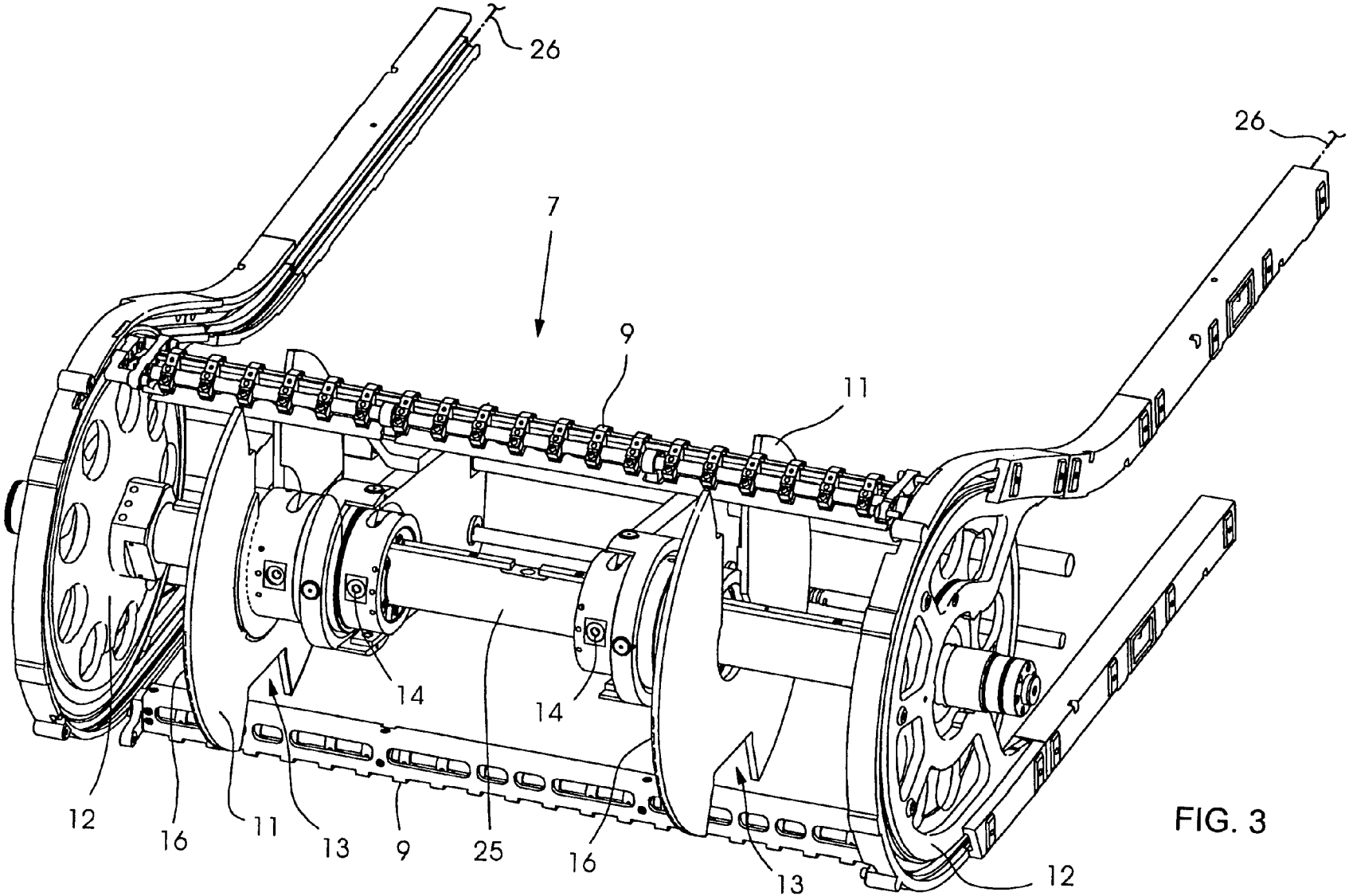
FIG. 3 is a fragmentary, perspective view of the delivery drum of FIG. 2.

FIG. 2 illustrates a transport phase of the sheet 1 that is particularly critical in regard to the smearing of the ink printed in the printing unit 3.1 from the sheet 1 to the sheet guide device 20. In this transport phase, the leading sheet end is gripped by a gripper 9 passing the delivery drum 7 and the trailing sheet end has already emerged from the press nip 24 (cf. FIG. 1) of the printing unit 3.2.

Without any suitable countermeasure, there would be a risk of the sheet 1 separating from the delivery drum 7 in the angular range $\alpha$ and forming a loop of printing material that, as a result of striking the sheet guide device 20, could cause smearing.

A countermeasure that prevents this and has been tested successfully by the applicant functions as set forth in the following text.

The vacuum channels 15, which act after the transfer point (drum-cylinder nip 23), and the blowing device 21 disposed before this transfer point act together such that the sheet 1 exactly maintains its substantially S-shaped longitudinal curvature following the peripheral lines of the impression cylinder 4 and of the delivery drum 7 during the critical transport phase and, thus, the disastrous formation of waves in the printing material of the sheet 1 is suppressed. In tests, it has been shown that the action of the blowing device 21 on its own is not completely adequate to force the sheet 1 into its requisite movement path and to keep it at a distance from the sheet guide device 20 within the angular range $\alpha$.

However, it is not ruled out that, in specific applications, by its vacuum, the delivery drum 7 is sufficiently effective on its own, that is to say, without any support by the blowing device 21.

Nonetheless, the combination of the pneumatic devices disposed on the two opposite sides of the transfer point (upstream blowing device 21, downstream angular range a of the vacuum delivery drum 7) has proven to be particularly effective.

This application claims the priority, under 35 U.S.C. §119, of German patent application No. 103 32 217.5, filed Jul. 16, 2003; the entire disclosure of the prior application is herewith incorporated by reference.

We claim:

1. A machine for processing sheets, comprising:

a delivery for delivering the sheets, said delivery having a delivery drum acted on pneumatically by having a vacuum applied thereto, said delivery drum having disks for carrying the sheet, each of said disks having respective diametric clearances, each of said disks defining respective vacuum channels for holding the sheets, at least one of said disks being adjustably mounted relative to another of said disks in a direction of a width of the sheets, said vacuum channels having openings, said openings and a vacuum connection together forming a rotary valve for cyclically applying the vacuum to said vacuum channels; and a chain conveyor having a circulation path, said delivery drum being disposed within said circulation path, said chain conveyor having gripper bridges, said gripper bridges plunging into said diametric clearances during circulation of said gripper bridges;

a second drum, said second drum and said delivery drum forming a sheet transfer point at which said second drum successively transfers the sheets to said gripper bridges;

said rotary valve being disposed such that said delivery drum is pneumatically active only within a vacuum-active angular range, said vacuum-active angular range beginning substantially only at said sheet transfer point.

2. The machine according to claim 1, further comprising:

said delivery drum and said second drum defining a drum-cylinder nip with an exit pocket;

said vacuum-active angular range of said delivery drum is disposed in said exit pocket of said drum-cylinder nip.

3. The machine according to claim 2, further comprising a sheet guide device adjacent to said delivery drum and extending into said vacuum-active angular range.

4. The machine according to claim 2, wherein:

said second drum is an impression cylinder; and a blowing device is associated with said impression cylinder for blowing the sheets against said impression cylinder.

5. The machine according to claim 4, wherein:

a third drum and said impression cylinder define a press nip; and said blowing device is associated with said impression cylinder between said press nip and said drum-cylinder nip.

6. The machine according to claim 1, wherein the machine is a perfecting press.

7. The machine according to claim 1, wherein said delivery delivers the sheets in a perfecting press.

8. The machine according to claim 1, wherein said vacuum-active angular range ends within a fourth quadrant of said delivery drum.

* * * * *